United States Patent [19]

Thörn

[11] 4,407,188

[45] Oct. 4, 1983

[54] SETTABLE SHUTTER DEVICE

[75] Inventor: Olov Thörn, Torshälla, Sweden

[73] Assignee: Pax Electro Products AB, Hälleforsnäs, Sweden

[21] Appl. No.: 253,531

[22] Filed: Apr. 13, 1981

[30] Foreign Application Priority Data

Apr. 11, 1980 [SE] Sweden ..... 8002743

[51] Int. Cl.[3] ..... F24F 7/013

[52] U.S. Cl. ..... 98/116; 251/138; 251/228

[58] Field of Search ..... 98/43 R, 116; 251/138, 251/228, 298

[56] References Cited

U.S. PATENT DOCUMENTS

| | | | |
|---|---|---|---|
| 957,776 | 5/1910 | Llg | 251/138 X |
| 2,850,258 | 9/1958 | Lazich | 251/138 X |
| 3,072,041 | 1/1963 | Downing | 98/116 |
| 3,263,906 | 8/1966 | Ward | 98/116 X |
| 3,284,044 | 11/1966 | Zaleske et al. | 251/138 |
| 3,960,464 | 6/1976 | Downing | 98/116 X |

FOREIGN PATENT DOCUMENTS

| | | | |
|---|---|---|---|
| 584775 | 11/1958 | Italy | 98/116 |

*Primary Examiner*—Albert J. Makay
*Assistant Examiner*—Harold Joyce
*Attorney, Agent, or Firm*—Browdy and Neimark

[57] ABSTRACT

A shutter blade device comprises a plurality of shutter blades which are pivotable each about its own tangentially extending pivot axis. Each shutter blade is provided with an elongated extension by means of which it passes through a slot into the interior of the apparatus body where the extension with its terminal portion meshes with an axially movable driver means. The driver means can be actuated electromagnetically or manually. The device is particularly suited for ventilators.

13 Claims, 12 Drawing Figures

SETTABLE SHUTTER DEVICE

FIELD OF THE INVENTION

The present invention refers to a settable shutter device comprising a plurality of radially extending, pivotable shutter blades having essentially the shape of an annular segment and being located between two concentric casings.

BACKGROUND OF THE INVENTION

Shutter devices of this kind are already known and are used principally for ventilators; one type is described e.g. in U.S. Pat. No. 3,960,464. The object of such shutter devices with ventilators is on the one hand to regulate, as required, the effect of the ventilator without having to regulate the ventilator motor itself, and on the other hand to prevent a so-called thermal fall when the ventilator is stopped; the shutter device shall then automatically close to prevent cold air from flowing into the space being ventilated.

SUMMARY OF THE INVENTION

An object of the invention is to provide a less complex device of the character described which also is less liable to suffer from defects, having among other other things fewer axially movable parts which might jam and fewer springs which might break. The device according to the invention can also easily be adapted for manual or automatic operation, as desired. The invention is characterized by the features apparent from the attached patent claims.

BRIEF DESCRIPTION OF THE DRAWINGS

The invention shall now be described by way of example more in detail with reference to the attached drawings which show in.

Figure 1:
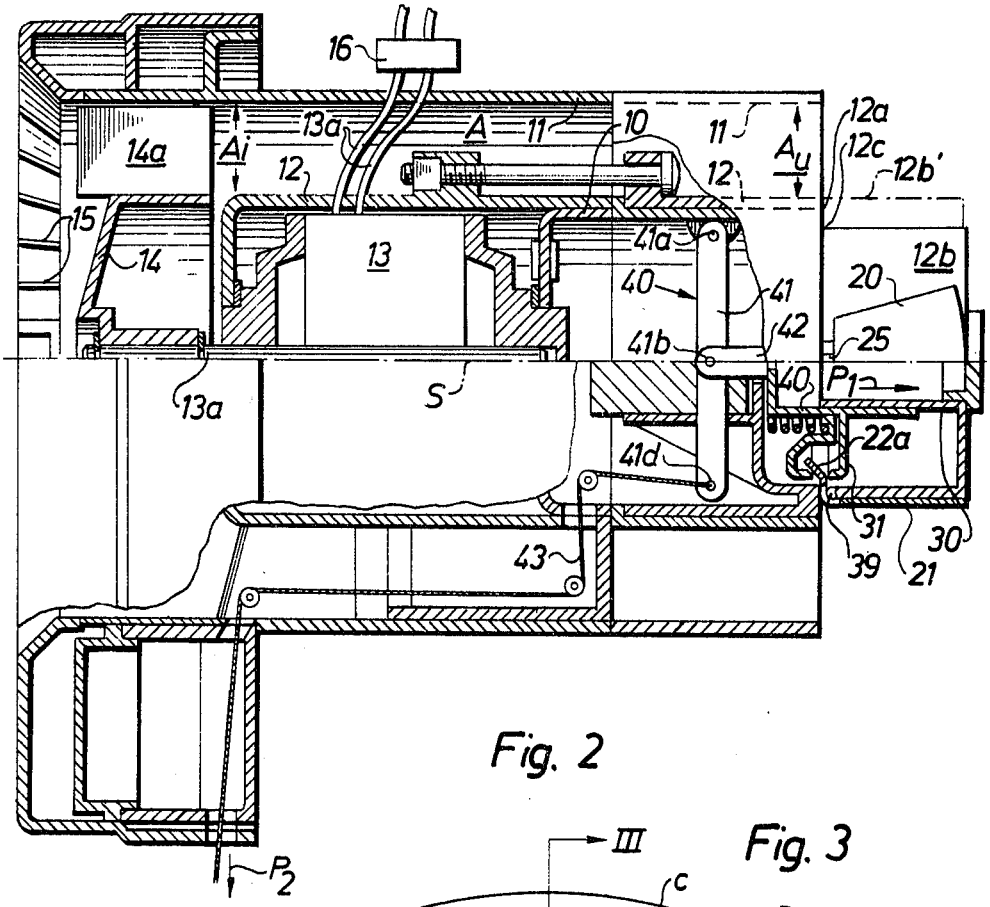
FIG. 1 partly in side view, partly in axial section, a first embodiment of the device according to the invention.

In all drawings the same or indexed reference numerals are used for identical or analogous components.

DESCRIPTION OF THE PREFERRED EMBODIMENTS

According to FIG. 1, a ventilator adapted to be built-in into a wall opening comprises an outer cylindrical casing 11 and an inner cylindrical casing 12 concentric therewith and in which an apparatus body 10 and an electric motor 13 with an outgoing shaft, on which an impeller 14 is mounted, are arranged. The blades 14*a* of the impeller are located before the inlet port $A_i$ of an annular duct or air channel A between the two cylindrical casings 11, 12. In front of the impeller 14 is a protection means, e.g. a screen 15, which also prevents objects which could damage the ventilator or obstruct its air channel A from being sucked in. The electric motor is by feeder cables 13*a* and via an interruptor 16 connected to a source of electric current, not shown, such as the mains. The whole device, i.e. also the casings 11, 12, has an axis of symmetry S. The apparatus so far described is conventional. The shutter device according to the present invention has the object to regulate, in a new way, the flow of air through the channel A, and possibly automatically close this duct when the motor 13 does not work, so that thermal losses may be avoided.

The inner cylindrical casing 12 of the apparatus body 10 is at its rear end provided with a shoulder 12*a* and continues therebeyond by a cylindrical or polygonal hub 12*b* with a reduced diameter. The shutter blades 20 are mounted in the fold 12*c* between the shoulder 12*a* and the hub 12*b* and they are pivotable each about its axis T—T (FIG. 11) which is parallel with tangents $T_{11}$ and $T_{12}$ (FIG. 11) of the two cylindrical casings 11, 12 and which itself is essentially tangent to the hub 12*b*.

Figure 2:
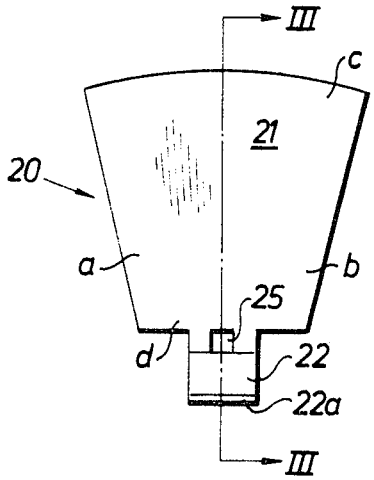
FIG. 2 in front view a shutter blade of the device according to FIG. 1.
Figure 3:
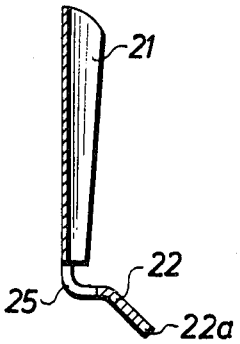
FIG. 3 the same shutter blade in longitudinal section along the plane III—III in FIG. 2.
Figure 4:
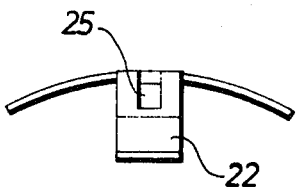
FIG. 4 in a view from beneath of the same blade.

According to FIGS. 2 to 4, each shutter blade 20 has a blade face 21 limited by two radially extending side edges a, b, a longer outer transverse edge c and a shorter inner transverse edge d from which protrudes an elongated, band-shaped extension 22 with a free terminal portion 22*a*. The blade face is curved transversally, i.e. in the direction of the transverse edges c, d, as is best seen in FIG. 4. The extension 22 is angled at approximately 45° relative to the blade face 21 by first being, closely to the blade face, angled at about 90° inwardly with respect to the concave side of the blade face, and then again angled at about 45° outwardly. In the knee adjacent the blade face 21 an opening 25 is formed in the extension 22.

In the fold 12*c* (FIG. 1) for each shutter blade 20 a short tangentially extending slot 33 (FIG. 5) is provided through which the extension 22 can pass to the interior of apparatus body 10. The length of the slot 33 corresponds essentially to the width of the extension 22. On one border of each slot 33 is a short protruding pin 39 which, at assembly, is introduced into the opening 25 in the extension 22, whereby the shutter blade is kept in place.

In the interior of the apparatus body 10 is fixed an axially extending guide tube 30, on which a driver means 31 is slidably mounted. The driver means 31 has a slot 34 (FIG. 5) extending along its entire periphery and with which all extensions 22 mesh at least with their free terminal portions 22*a*. When the driver means 31 is moved on the guide tube 30 in the sense of arrow $P_1$, all shutter blades 20 are lifted from their folded position in which the duct A is free, until they fully bear against the shoulder 12*a*, at which time the duct A is totally closed. It will be readily understood that when the driver means 31 is moved along a shorter path, the duct A will be only partially and correspondingly closed.

The driver means 31 is constantly biased in the sense of arrow $P_1$ by a helical compression spring 40', meaning that the duct A is always closed when the spring force is not counteracted. For opening the duct A, a mechanical actuating device 40 is used in the embodiment of FIG. 1, comprising a bar 41 which at 41*a* is pivotally connected to the apparatus body 10 and at 41*b* is, also pivotally, connected to the driver means 31. A flexible pulling means 43 such as a ball chain is attached to the bar 41 at 41*d*. When this pulling means is moved in the sense of arrow $P_2$, the effect of spring 40 is overcome and the driver means 31 and the shutter blades 20 are brought into the position shown in FIG. 1, i.e. blades folded and duct A open.

It will be appreciated from the study of FIG. 1 that the shoulder 12*a* is not necessary and that the hub 12*b* may have the same diameter as the inner casing 12, as is shown in dashed lines at 12*b*'.

Figure 5:
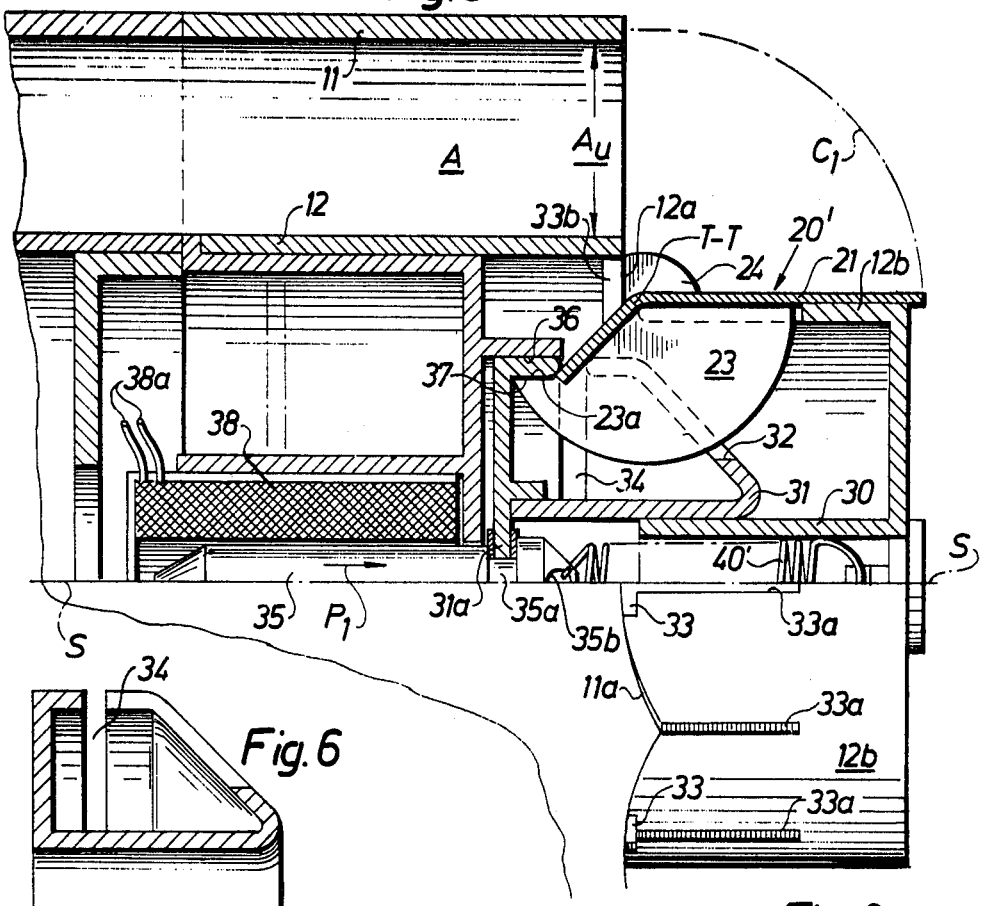
FIG. 5 partly in side view, partly in axial section, a second embodiment of the device acccording to the invention.
Figure 6:
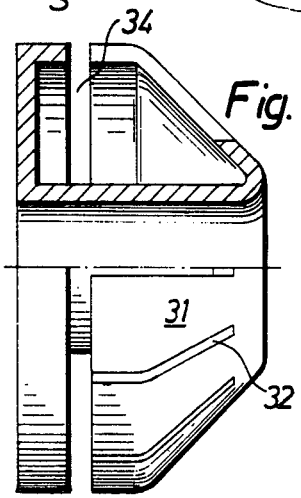
FIG. 6 in detail the driver means of FIG. 5.
Figure 7:
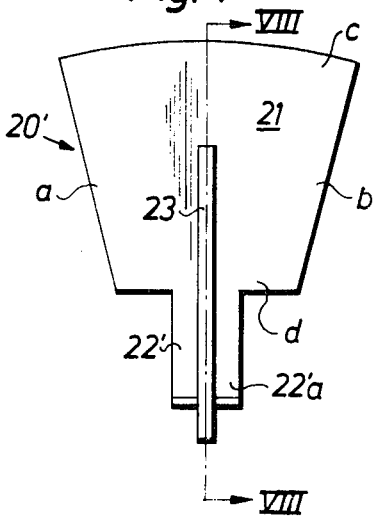
FIGS. 7 to 9 in an analogous manner to FIGS. 2 to 4, a shutter blade in the device according to FIG. 5.
Figure 8:
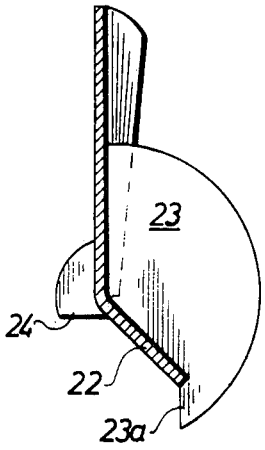
Figure 9:
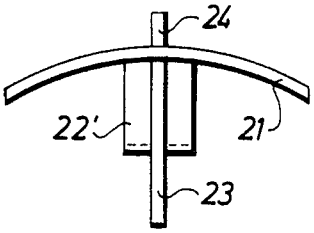

In the device of FIG. 5, the driver means 31 is operated electromagnetically and the shutter blades 20' have the shape which is evident from FIGS. 7 to 9. The extension 22' is angled only once and has no opening. At right angles to the blade face 21 and to the extension 22' and in their plane of symmetry VIII—VIII, is on the inner side of the shutter blade a larger guide segment 23, and on the outer side a smaller guide segment 24 are affixed. The blade surface 21 is transverse, i.e. in the direction of the transverse edges c, d curved, as is best seen in FIG. 9. Both guide segments 23, 24 are segments of circles having their centers of curvature on the pivot axis T—T of shutter blade 20'. The object of the guide segments 23, 24 is on the one hand to stiffen the shutter blade, and on the other hand to hold this blade and guide it in its movements. The inner segment 23 does not terminate at the end of the extension 22', but continues to a stop edge 23*a* a bit therebeyond. The purpose of this outer segment is to complement the inner segment, in particular for the guiding function.

In the hub 12*a* is an axial slot 33*a* arranged in connection with every tangential slot 33, and in the shoulder 12*a* is a radial slot 33*b* arranged. The slot 33*a* is provided for the passage of the segment 23 and the slot 33*b* for the passage of the segment 24. Each slot 33*a* is adapted to receive and let pass through one inner segment 23, and the number of the slots 33 corresponds consequently to the number of the shutter blades. The slots 33 and 33*a* together have the shape of a letter "T". Expediently, the length of the slots 33*a*, 33*b* corresponds to the radii of the segments 23, 24 respectively and the length of the slot 33 corresponds to the width of the extension 22'. Owing to the co-operation of the extension and the guide segment or segments with the respective slots, a material pivot shaft can be dispensed with.

In the driver means 31, besides the annular slot 34, straight slots 32 are provided for each of the guiding segments 23. All the straight slots 32 open out, at their one end, into the annular slot 34. In one of the two limit positions of the device shown in the drawing, edge 23*a* bears against a cylindrical inner wall 37 in the driver means 31. When all of the shutter blades 20' (a convenient number is e.g. 8 to 16 blades) have been introduced in their respective slots 33, 33*a*, 33*b*, the free ends 22'*a* of the extensions 22' penetrate into the annular slot 34 in the driver means 31. When this means is located in the one of its two limit positions shown in FIG. 5, the shutter blades 20' bear against the hub 12*b*, to which purpose they preferably are transversely curved, as shown e.g. in FIG. 9, and the duct A is totally open. When the driver means 31 is moved on the guide tube 30 is the sense of arrow $P_1$, all shutter blades are lifted (their outer edges travelling along a circle $C_1$) until the duct A becomes totally closed. In the example shown, the outer cylindrical casing 11 is at its rear border provided with a plurality of recesses 11*a* for the reception of the curved shutter blades in their maximally lifted position. In a selected intermediate position of the driver means 31 on the guide tube 30, the duct A is of course to a selected degree partially closed.

The driver means 31 is in the embodiment of FIG. 5 also guided at its outer periphery at 36. It is moved in such a way that a lip or shoulder 31*a* thereon engages a notch 35*a* on an axially movable rod 35 which defines the armature of an electromagnetic winding 38 having feeder cables 38*a*. A helical tension spring 40' biases the rod 35 by being anchored in an opening 35*b* in the rod 35 and constantly urges the driver means 31 into its limit position corresponding to a closed duct A, i.e. in the sense of arrow $P_1$. When the electromagnetic actuating means 35, 38 via its feeder cables 38*a* is operationally connected to the ventilator motor 13 or to its interruptor 16, the duct A gets automatically closed when the ventilator is stopped, and thermal loss is prevented.

Figure 10:
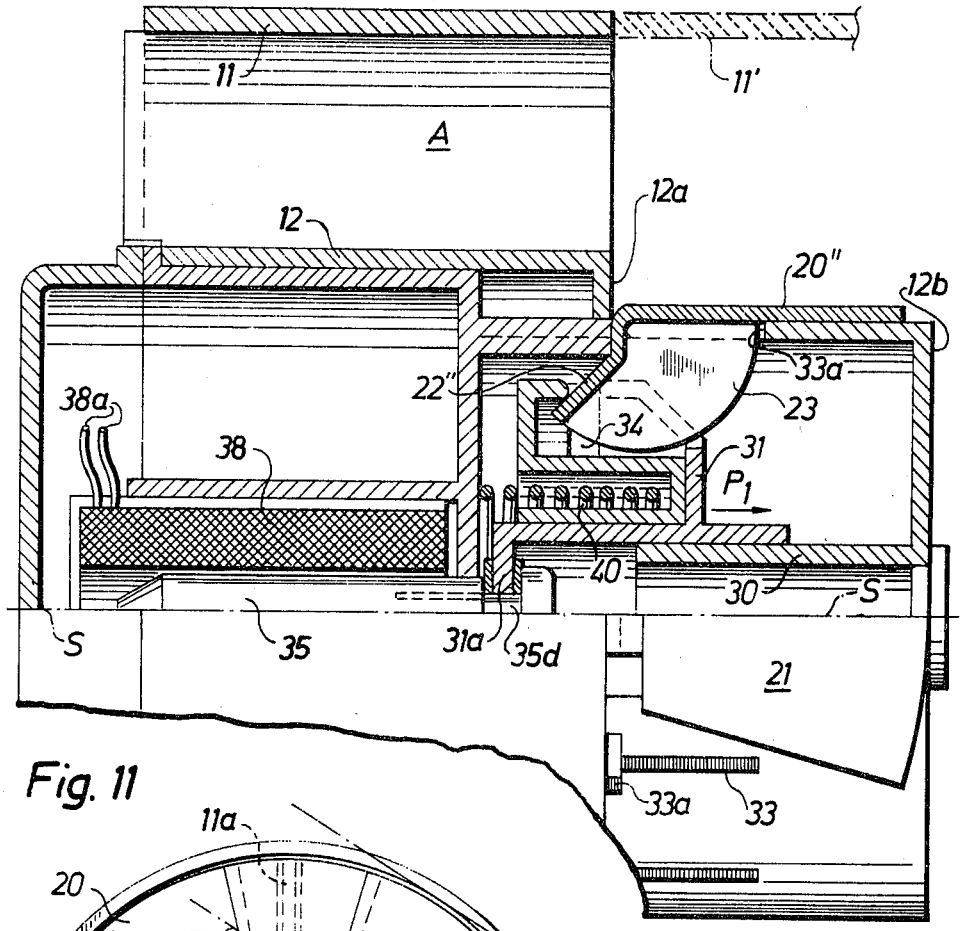
FIG. 10 a third embodiment of the device according to the invention.

The outer segment 24 and/or the stop edge 23*a* of the inner one are not absolutely necessary, as will be recognized from the study of FIG. 10 where they are missing and the extension 22'' has essentially the same shape as in FIG. 1, but without the opening 25.

Figure 11:
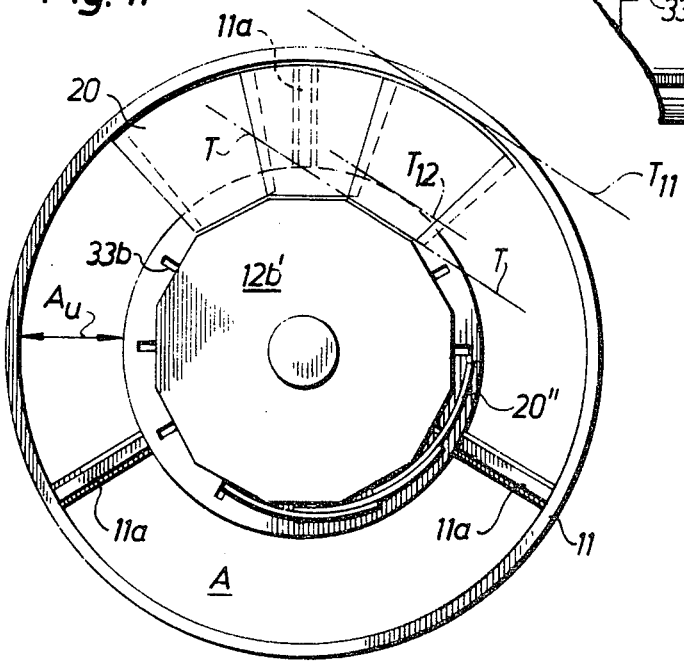
FIG. 11 in a rear view, and at a smaller scale, the embodiment of FIG. 10, and FIG. 12 at a smaller scale in perspective view a further embodiment of the shutter blade according to the invention.

According to FIG. 11, the hub 12*b*' has the cross-sectional form of a dodecahedron and is provided with twelve shutter blades 20'' of which, in the upper part of the drawing, only three blades in lifted position, and in the lower part, three blades in the folded-down position are shown (in practice, of course, all shutter blades in one assembly are always in the same position). The shutter blades overlap partly one another, more so in the folded-down position, and less in the lifted position. The slots 33*a* (FIG. 5) lie on the axes of symmetry of each polygon-side of the hub, opposite the slots 33*b* in the shoulder 12*a*. Three rigid spokes 11A connect the outer cylindrical casing 11 with the inner cylindrical casing 12.

Figure 12:
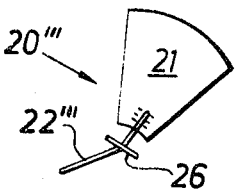

In principle, it is of course also possible to provide, according to FIG. 12, each shutter blade 20''' having a rod-shaped extension 22''' with a material shaft 26 defining the pivot axis T—T. To mount a plurality of such shafts, extending tangentially to hub 12*b*, and arranging the shutter blades thereon, might however be quite expensive and lead to a greater frequency of faults. One of the advantages of the present invention is that such a material shaft is not needed, the blades being satisfactorily retained for pivoting about the axis T—T either with the aid of the pins 39 and the openings 25, or by means of at least one of the guide segments 23, 24 which move in the slots 33, 34.

The device according to the present invention can be optionally constructed as an integral component part of a ventilator, or as an addition which possibly may be mounted on an existing ventilator. It will be recognized that instead of the cylindrical casings 11, 12 also polygonal ones can be used, in analogy to the polygonal hub 12*b*'. It will be further appreciated that, in principle, the shutter blade assembly also may be arranged at the inlet port $A_i$ of the air channel A, FIG. 1. This incidentally happens also when the sense of rotation of the impeller 14 is reversed. The shutter blade assembly may also be located inside the channel A, if e.g. the outer cylindrical casing 11 is extended at 11', as shown in FIG. 10.

While the invention has been described in detail above, it is to be understood that this detailed description is by way of example only, and the protection granted is to be limited only within the spirit of the invention and the scope of the following claims.

What is claimed is:

1. A settable shutter device particularly for use with a ventilator comprising an annular channel defined by an outer casing and a concentric inner casing located about the axis of said ventilator, said ventilator comprising an apparatus body and means to mount said apparatus body within said inner casing, said shutter device comprising a plurality of shutter blades adapted to control air flow through said annular channel, each of said shutter blades having the shape of an annular segment defined by a pair of radial sides, a longer outer transverse edge and a shorter inner transverse edge, each of said shutter blades comprising an elongated extension extending generally radially from said inner edge and, when mounted, radially towards the ventilator axis, said extension having a transverse extent less than the transverse extent of said inner transverse edge, each of said shutter blade extensions having a portion bent out of planes radial to said ventilator axis, means to pivotally mount said blades each about its own axis closely spaced to the periphery of said inner casing, each said blade axis being generally tangential to said inner casing, respective opening means formed in said inner casing to permit said elongated blade extensions to pass therethrough to the inside of said inner casing, each of said blades comprising stabilizing means to stabilize the position of each said blade in said opening means, driver means for controlling the motion of said blades and to determine any set position of said blades between two limit positions where said channel is completely open or completely closed, said driver means being located concentrically inside said inner casing, means to permit motion of said driver means axially of said ventilator axis, spring means normally urging said blades toward one of said limit positions, said driver means being formed with circumferentially arranged actuating means engaging the inner ends of all said blade extensions in all positions of said blades with respect to said channel and in all corresponding positions of driver means.

2. Device according to claim 1, wherein each said extension has the shape of a flat band and the opening means for the extension is defined by a tangentially extending slot in the inner casing, the length of the slot corresponding essentially to the width of the extension.

3. Device according to claim 1 or 2, wherein said stabilizing means are defined by shafts extending tangentially relative to the inner casing.

4. Device according to claim 1 or 2, wherein said stabilizing means are defined by at least one guiding segment extending essentially at right angles to the face of the shutter blade and of the extension, and on the inner casing there is provided an axially and/or radially extending slot for the passage of each said segment.

5. Device according to claim 1 or 2, wherein the stabilizing means are defined by an opening in the band-shaped extension and by a pin protruding from the border of each passage and on which the extension is mounted with the aid of said opening.

6. Device according to claim 1 or 2, wherein the driver means is slidably mounted on an axial guide tube.

7. Device according to claim 1 or 2, wherein an actuating force for the driver means is supplied by an electromagnetic winding and an axially movable magnetic armature.

8. Device according to claim 7, wherein the energy supply of the magnetic winding is coupled to the energy supply of the electric motor.

9. Device according to claim 4, wherein said stabilizing means comprises a second guiding segment extending co-planar with the first segment on the opposite side of the shutter blade.

10. Device according to claim 1 or 2, wherein said spring means urges said blades to the position wherein said channel is closed.

11. Device according to claim 1 or 2, wherein said plurality of shutter blades comprises twelve such blades.

12. Device according to claim 1 or 2, wherein said blades overlap each other in all positions of said blades, and overlap each other less when they are closing off said channel that when said channel is open.

13. Device according to claim 1 or 2, wherein said circumferentially arranged actuating means comprises a circumferential slot with the inner ends of said blade extensions engaging into said slot.

* * * * *